US008810618B2

(12) United States Patent
Fujiwara et al.

(10) Patent No.: US 8,810,618 B2
(45) Date of Patent: Aug. 19, 2014

(54) THERMAL HEAD AND THERMAL PRINTER INCLUDING THE SAME

(75) Inventors: Yoshihiko Fujiwara, Kirishima (JP); Hiroshi Masutani, Kirishima (JP)

(73) Assignee: Kyocera Corporation, Kyoto (JP)

( * ) Notice: Subject to any disclaimer, the term of this patent is extended or adjusted under 35 U.S.C. 154(b) by 0 days.

(21) Appl. No.: 13/997,926

(22) PCT Filed: Dec. 17, 2011

(86) PCT No.: PCT/JP2011/079260

§ 371 (c)(1), (2), (4) Date: Jun. 25, 2013

(87) PCT Pub. No.: WO2012/086558

PCT Pub. Date: Jun. 28, 2012

(65) Prior Publication Data

US 2013/0286137 A1 Oct. 31, 2013

(30) Foreign Application Priority Data

Dec. 25, 2010 (JP) ..... 2010-289001

(51) Int. Cl.
*B41J 2/335* (2006.01)

(52) U.S. Cl.
CPC ..... *B41J 2/33515* (2013.01); *B41J 2/3355* (2013.01)
USPC ..... 347/204

(58) Field of Classification Search
USPC ..... 347/200, 202, 203, 204
See application file for complete search history.

(56) References Cited

FOREIGN PATENT DOCUMENTS

| | | | | |
|---|---|---|---|---|
| JP | S5720373 | A | 2/1982 | |
| JP | S60135268 | A | 7/1985 | |
| JP | 6245002 | A | 2/1987 | |
| JP | 6293901 | A | 4/1987 | |
| JP | 62-202753 | * | 9/1987 | ..... B41J 3/20 |
| JP | 62-202756 | * | 9/1987 | ..... B41J 3/20 |
| JP | 04052148 | A | 2/1992 | |
| JP | H0796618 | A | 4/1995 | |
| JP | 07205465 | A | 8/1995 | |
| JP | 2003072125 | A | 3/2003 | |
| JP | 2005067160 | A | 3/2005 | |
| JP | 2009154371 | A | 7/2009 | |
| JP | 2010173128 | A | 8/2010 | |

OTHER PUBLICATIONS

International Search Report, PCT/JP2011/079260, Jan. 16, 2012, 1 pp.
Japanese Office Action with English concise explanation, Japanese Patent Appln. No. 2012-549781, Apr. 8, 2014, 9 pp.

* cited by examiner

*Primary Examiner* — Huan Tran
(74) *Attorney, Agent, or Firm* — Volpe and Koenig, P.C.

(57) ABSTRACT

A thermal head in which power durability of the heat-generating element is improved and a thermal printer including the same. A thermal head according to an embodiment includes a substrate, electrodes disposed in a pair on the substrate, a heat-generating element disposed between the electrodes and connecting the electrodes to one another, an electric resistor layer disposed below the electrodes, and a protection film disposed on the electrodes and the heat-generating element. The electrodes include a first electrode and a second electrode electrically connected to the heat-generating element. The heat-generating element and the electric resistor layer each contain at least one metal selected from Al, Cu, Ag, Mo, Y, Nd, Cr, Ni and W, in a region on a protection film side thereof. A content of the metal contained in the heat-generating element is higher than a content of the metal contained in the electric resistor layer disposed below the first electrode.

13 Claims, 8 Drawing Sheets

(c)

(d)

THERMAL HEAD AND THERMAL PRINTER INCLUDING THE SAME

FIELD OF INVENTION

The present invention relates to a thermal head and a thermal printer including the same.

BACKGROUND

Various types of thermal heads have been heretofore proposed as printing devices for a facsimile, a video printer or the like. For example, a thermal head described in Patent Literature 1 includes a substrate, electrodes disposed in a pair on a substrate, a heat-generating element disposed between the electrodes and connecting the electrodes to each other, and an electric resistor layer disposed below the electrodes. Then, the thermal head has a protection film formed on a region of the heat-generating element and the electrodes.

CITATION LIST

Patent Literature

Patent Literature: Japanese Unexamined Patent Publication JP-A 2010-173128

SUMMARY

Technical Problem

In the thermal head described in JP-A 2010-173128, the heat-generating element is made of a TaSiO-based, a TaSiNO-based, a NbSiO-based or a TiSiO-based material. When large electric power is supplied to the heat-generating element formed as the above, the heat-generating element is annealed and electric resistance of the heat-generating element is reduced, which causes a problem that a heating temperature of the heat-generating element is increased to be higher than a given temperature.

The invention has been made for solving the above problem, and an object thereof is to provide a thermal head in which power durability of the heat-generating element is improved and a thermal printer including the same.

Solution to Problem

A thermal head according to an embodiment of the invention includes a substrate, electrodes disposed in a pair on the substrate, a heat-generating element disposed between the electrodes and connecting the electrodes to one another, an electric resistor layer disposed below the electrodes, and a protection film disposed on the electrodes and the heat-generating element. The electrodes includes a first electrode and a second electrode electrically connected to the first electrode and the heat-generating element, and the heat-generating element and the electric resistor layer each contain at least one metal selected from Al, Cu, Ag, Mo, Y, Nd, Cr, Ni and W, in a region on a protection film side thereof. A content of the at least one metal contained in the heat-generating element is higher than a content of the at least one metal contained in the electric resistor layer disposed below the first electrode.

A thermal head also according to an embodiment of the invention includes a substrate, electrodes disposed in a pair on the substrate, a heat-generating element disposed between the electrodes and connecting the electrodes to one another, an electric resistor layer disposed below the electrodes, and a protection film disposed on the electrodes and the heat-generating element. The heat-generating element and the electric resistor layer each contain at least one metal selected from Al, Cu, Ag, Mo, Y, Nd, Cr, Ni and W, in a region on a protection film side thereof, and part of the at least one metal exists as its oxide, and a content of the oxide of the at least one metal contained in the heat-generating element is higher than a content of the oxide of the at least one metal contained in the electric resistor layer.

A thermal printer according to an embodiment of the invention includes the above-mentioned thermal head, a conveyance mechanism conveying a recording medium on the heat-generating element and a platen roller which presses the recording medium on the heat-generating element.

Advantageous Effects of Invention

According to the invention, it is possible to provide a thermal head in which power durability of the heat-generating element is improved and a thermal printer including the same.

DETAILED DESCRIPTION OF THE PREFERRED EMBODIMENTS

Figure 1:
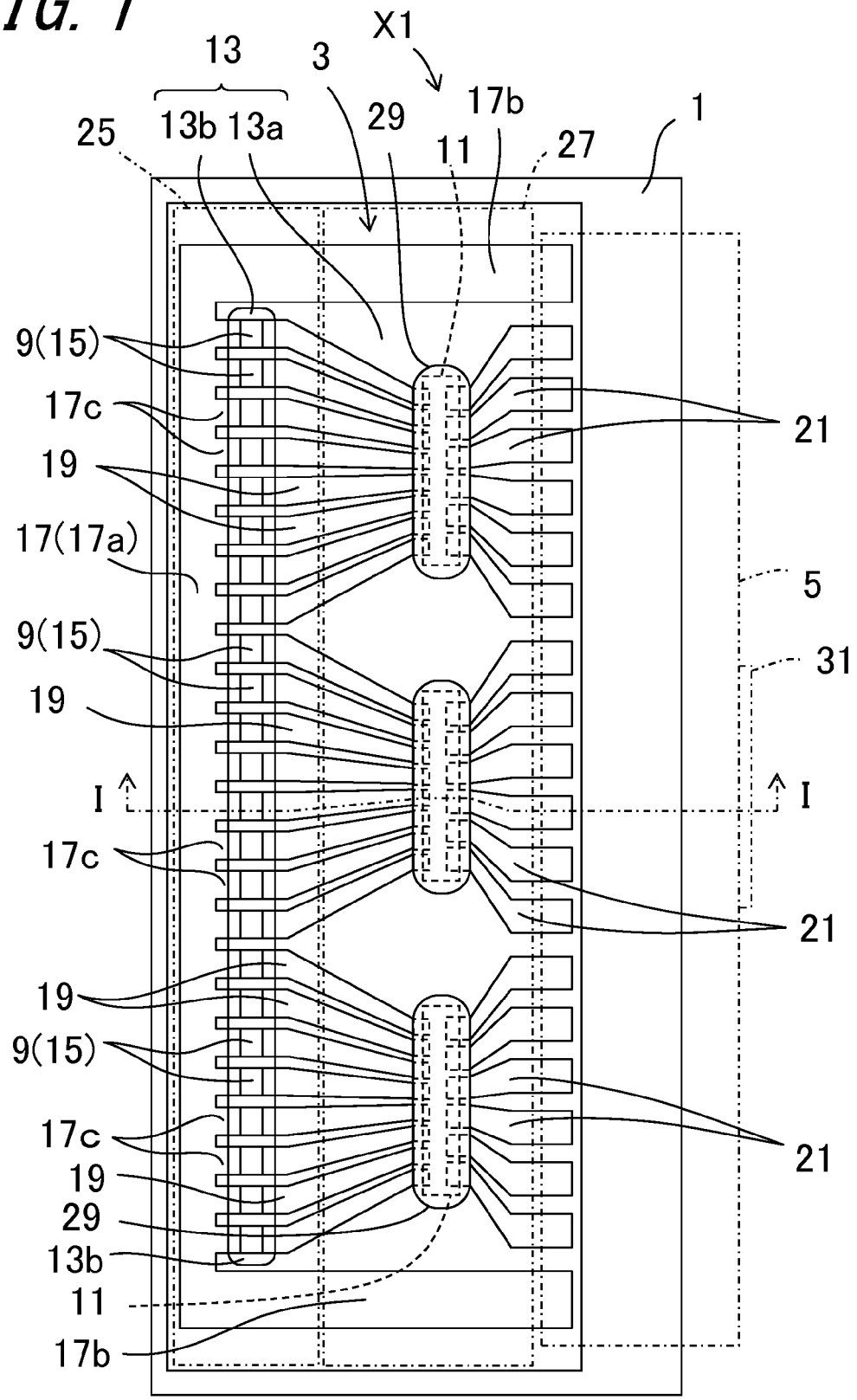
FIG. 1 is a plan view showing a thermal head according to an embodiment of the invention.
Figure 2:
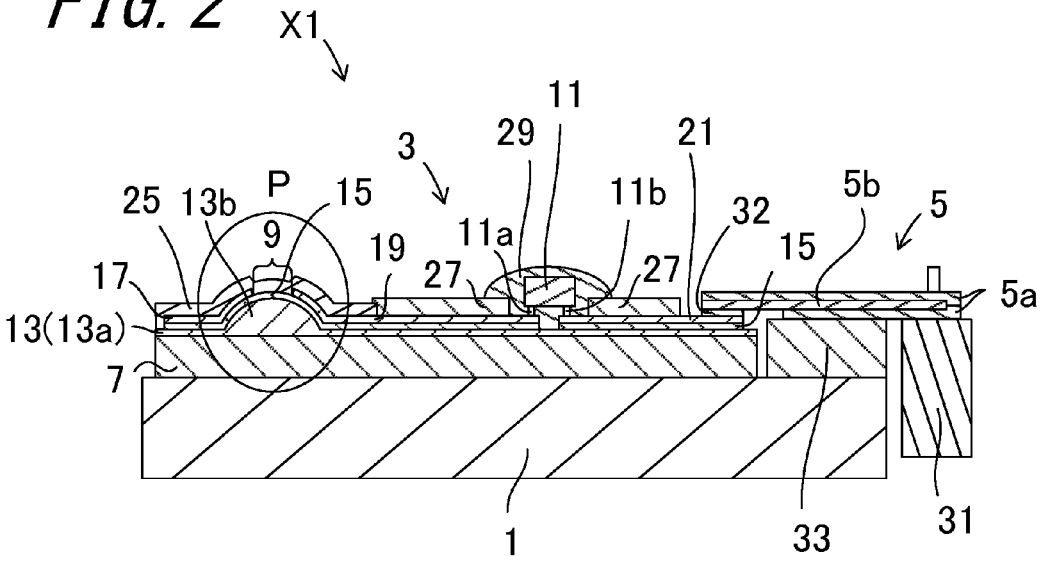
FIG. 2 is a cross-sectional view taken along I-I line of FIG. 1.

Hereinafter, a thermal head according to an embodiment of the invention will be described with reference to the drawings. As shown in FIGS. 1 and 2, a thermal head X1 of the present embodiment includes a heat dissipation member 1, a head base 3 disposed on the heat dissipation member 1 and a flexible printed circuit board 5 (hereinafter referred to as "FPC 5") connected to the head base 3. In FIG. 1, the FPC 5 is not shown and a region where the FPC 5 is disposed is represented by a chain double-dashed line.

The heat dissipation member 1 is formed in a plate and having a rectangular shape in a plan view. The heat dissipation member 1 is made of a metal material such as copper or aluminum. The heat dissipation member 1 has a function of radiating part of heat not contributed to printing in heat generated at heat-generating elements 9 of the head base 3 as described later. The head base 3 is bonded to an upper surface of the heat dissipation member 1 by a double-faced tape, adhesives or the like (not shown).

The head base 3 includes a substrate 7 having a rectangular shape in a plan view, a plurality of heat-generating elements 9 disposed on the substrate 7 and arranged along a longitudinal direction of the substrate 7 and a plurality of driver ICs 11 disposed side by side on the substrate 7 along the arrangement direction of the heat-generating elements 9.

The substrate 7 is made of an electric insulating material such as alumina ceramics or a semiconductor material such as monocrystalline silicon.

A thermal storage layer 13 is disposed on an upper surface of the substrate 7. The thermal storage layer 13 has a base portion 13*a* disposed over the entire upper surface of the substrate 7 and a raised portion 13*b* extending along the arrangement direction of the plurality of heat-generating elements 9 in a band shape and having an approximately semi-elliptical shaped cross section. The raised portion 13*b* has a function of pressing a recording medium to be printed onto a later-described protection film 25 disposed on the heat-generating elements 9.

The thermal storage layer 13 is made of, for example, glass having low thermal conductivity and is capable of temporarily accumulating part of heat generated in the heat-generating elements 9. Accordingly, the thermal storage layer 13 functions so as to shorten the time necessary for increasing the temperature of the heat-generating elements 9 and increase thermal response characteristics of the thermal head X1. The thermal storage layer 13 is formed by, for example, applying on the upper surface of the substrate 7 a given glass paste obtained by mixing a suitable organic solvent into glass powder by using a well-known screen printing or the like, and firing the mixture.

As shown in FIG. 2, an electric resistor layer 15 is disposed on an upper surface of the thermal storage layer 13. The electric resistor layer 15 is interposed between the thermal storage layer 13 and a later-descried common electrode 17, individual electrodes 19 and IC-FPC connection electrodes 21. When seen in a plan view, the electric resistor layer 15 has regions having the same shapes of these common electrode 17, the individual electrodes 19 and the IC-FPC connection electrodes 21 (hereinafter referred to as "interposed regions") as well as a plurality of regions exposed from between the common electrode 17 and the individual electrode 19 (hereinafter referred to as "exposed regions"). Note that the interposed regions of the electric resistor layer 15 are hidden by the common electrode 17, the individual electrodes 19 and the IC-FPC connection electrodes 21 in FIG. 1.

Respective exposed regions of the electric resistor layer 15 form the heat-generating elements 9. Then, the plurality of heat-generating elements 9 are arranged in a line on the raised portion 13*b* of the thermal storage layer 13 as shown in FIG. 1. The plurality of heat-generating elements 9 are shown in a simple manner for convenience of explanation, which are arranged in a density of, for example, 180 dpi to 2400 dpi (dot per inch).

The electric resistor layer 15 is made of a material having relatively high electric resistance such as a TaN-based, a TaSiO-based, a TaSiNO-based, a TiSiO-based, a TiSiCO-based or a NbSiO-based material. Accordingly, when a voltage is applied between the later-described common electrode 17 and the individual electrode 19, and the voltage is applied to the heat-generating elements 9, the heat-generating elements generate heat due to Joule heat. Additionally, the electric resistor layer 15 contains at least one metallic element selected from Al (aluminum), Cu (copper), Ag (silver), Mo (molybdenum), Y (yttrium), Nd (neodymium), Cr (chrome), Ni (nickel) and W (tungsten), in a region on the later-described protection film 25 side thereof. Note that a region of the heat-generating elements 9 on the protection film 25 side indicates a region from an interface between the heat-generating elements 9 and the protection film 25 to a height of 0.05 μm. The region of the electric resistor layer 15 on the protection film 25 indicates a region from an interface between the heat-generating elements 9 and the common electrode 17, the individual electrodes 19, the IC-FPC connection electrodes 21 to a height of 0.05 μm.

As shown in FIGS. 1 and 2, the common electrode 17, the plurality of individual electrodes 19 and the plurality of IC-FPC connection electrodes 21 are disposed on an upper surface of the electric resistor layer 15. These common electrode 17, the individual electrodes 19 and the IC-FPC connection electrodes 21 are made of a material having conductivity, which is, for example, at least one metal selected from Al, Cu, Ag, Mo, Y, Nd, Cr, Ni and W or an alloy including these metals.

The common electrode 17 is configured to connect the plurality of heat-generating elements 9 to the FPC 5. As shown in FIG. 1, the common electrode 17 has a main wiring portion 17*a* extending along one long side of the substrate 7. Additionally, the common electrode 17 has two sub-wiring portions 17*b* respectively extending one and the other short sides of the substrate 7, one end portions of which are connected to the main wiring portion 17*a*. The common electrode 17 has a plurality of lead portions 17*c* individually extending toward respective heat-generating elements 9 from the main wiring portion 17*a*, tip portions of which are connected to respective heat-generating elements 9. Then, the other end portions of the sub-wiring portions 17*b* are connected to the FPC 5, and thus the common electrode 17 electrically connects the FPC 5 to respective heat-generating elements 9.

The plurality of individual electrodes 19 are for connecting respective heat-generating elements 9 to the driver ICs 11. As shown in FIG. 1 and FIG. 2, one end portions of the respective individual electrodes 19 are connected to each of the heat-generating elements 9, and the other end portions thereof are connected to arrangement regions of the driver ICs 11. The respective individual electrodes 19 individually extend in a band toward the arrangement regions of the driver ICs 11 from respective heat-generating elements 9. Then, the other end portions of respective individual electrodes 19 are connected to the driver ICs 11, which electrically connects between respective heat-generating elements 9 and the driver ICs 11. In more detail, the individual electrodes 19 divides a plurality of heat-generating elements 9 into plural groups, and electrically connect the heat-generating elements 9 in respective groups to the driver ICs 11 disposed so as to correspond to respective groups.

In the present embodiment, the lead portions 17*c* of the common electrode 17 and the individual electrodes 19 are connected to the heat-generating elements 9 as described above, and the lead groups 17*c* and the individual electrodes 19 are disposed so as to face each other. In the present embodiment, electrodes to be connected to the exposed regions in the electric resistor layer 15 to become the heat-generating elements 9 are formed in pairs. Namely, the lead portions 17*c* and the individual electrodes 19 make electrodes formed in pairs in the present embodiment. Additionally, the common electrode 17 and the individual electrodes which are electrodes include a first electrode 18 and a second electrode 16 connecting the first electrode 18 to a heat-generating element 9 (refer to FIG. 5(*f*)) which will be described later.

The plurality of IC-FPC connection electrodes 21 are for connecting the driver ICs 11 to the FPC 5. As shown in FIG. 1 and FIG. 2, respective IC-FPC connection electrodes 21 extend in a band so that one end portions are arranged in the arrangement region of the driver ICs 11 and the other end portions are arranged in the vicinity of the other long side of the substrate 7. Then, the plurality of IC-FPC connection electrodes 21 electrically connect between the driver ICs 11 and the FPC 5 as one end portions are connected to the driver ICs 11 and the other end portions are connected to the FPC 5.

In more detail, the plurality of IC-FPC connection electrodes 21 connected to respective driver ICs 11 includes a plurality of wirings having different functions. The plurality of IC-FPC connection electrodes 21 include an IC power wiring, a ground electrode and an IC control wiring. The IC power wiring has a function for supplying power supply current for operating the driver IC 11. The ground electrode has a function of maintaining the driver IC 11 and the individual electrodes 19 connected to the driver IC 11 in a ground potential. The IC control wiring has a function of operating the driver IC so as to control on/off states of later-described switching devices in the driver IC 11.

The driver ICs 11 are disposed so as to correspond to respective groups of a plurality of heat-generating elements 9 and are connected to the other end portions of the individual electrodes 19 and one end portions of the IC-FPC connection electrodes 21 as shown in FIGS. 1 and 2. The driver ICs 11 are for controlling a conducting state of respective heat-generating elements 9, and well-known ones having a plurality of switching devices inside can be used, which becomes conductive when respective switching devices are in an on-state and becomes non-conductive when the respective switching devices are in an off-state.

The driver ICs 11 are provided with a plurality of switching devices (not shown) inside so as to correspond to the respective individual electrodes 19 connected to the respective driver ICs 11. Then, one connection terminals 11*a* (hereinafter referred to as "first connection terminals 11*a*") of the respective driver ICs 11 connected to the respective switching devices are connected to the individual electrodes 19 as shown in FIG. 2. The other connection terminals 11*b* (hereinafter referred to as "second connection terminals 11*b*") connected to the respective switching devices are connected to the ground electrode of the IC-FPC connection electrodes 21. Accordingly, when the respective switching devices of the driver ICs 11 are in the on-state, the individual electrodes 19 and the ground electrode of the IC-FPC connection electrodes 21 which are connected to the respective switching devices are electrically connected.

The above-described electric resistor layer 15, the common electrode 17, the individual electrodes 19 and the IC-FPC connection electrodes 21 are formed by, for example, sequentially stacking material layers forming respective components on the thermal storage layer 13 by using, for example, a well-known thin-film forming technique such as sputtering, then, processing a stacked body into a given pattern by using well-known photo-etching or the like.

Moreover, the heat-generating elements 9 and the electronic resistor layer 15 each contain at least one metal selected from Al, Cu, Ag, Mo, Y, Nd, Cr, Ni and W, at least on the surface on the later-described protection film 25 side thereof. A metal content in the heat-generating elements 9 is higher than a metal content in the electric resistor layer 15 disposed below the first electrode 18 (refer to FIG. 5(*f*)).

The metal content in the heat-generating elements 9 is preferably 1 to 5% by atom, and the metal content in the electric resistor layer 15 disposed below the first electrode 18 is preferably 0.1 to 3% by atom. Part of these metals is dissolved and exists in the metal forming the heat-generating elements 9 as a solid solution. Moreover, part of these metals reacts to the metal forming the heat-generating elements 9 and exists as an intermetallic compound. Since these metals exist as the intermetallic compound, the rearrangement of a metallic crystal forming the heat-generating elements 9 proceeds, which can suppress the increase of an electric resistance value of the thermal head X1 in an initial state. Note that the metal content indicates a ratio with respect to the total amount of elements measured by a later-described XPS when using the XPS.

Furthermore, part of these metals is oxidized and exists as a metal oxide. Accordingly, when the heat-generating elements 9 are annealed and the electric resistance value is reduced as a high voltage is applied to the thermal head X1, the electric resistance value of the heat-generating elements 9 can be increased and the reduction of the electric resistance value can be suppressed as part of metals is oxidized and exists as the metal oxide. Therefore, it is preferable that a metal oxide content in the heat-generating elements 9 is higher than a metal oxide content in the electric resistor layer 15 disposed below the first electrode 18 from a point of view that the reduction of the electric resistance value can be suppressed. It is also preferable that the metal oxide content in the heat-generating elements 9 is higher than the metal oxide content in the electric resistor layer 15 disposed below the first electrode 18 and the second electrode 16. Also in this case, the above advantage can be obtained.

As shown in FIGS. 1 and 2, the protection film 25 covering the heat-generating elements 9, part of the common electrode 17 and part of the individual electrodes 19 is formed over the thermal storage layer 13 formed on the upper surface of the substrate 7. A forming region of the protection film 25 is represented by a dashed line and is not shown in FIG. 1 for convenience of explanation. In the shown example, the protection film 25 is disposed so as to cover a region on the left side on the upper surface of the thermal storage layer 13. In more detail, the protection film 25 is disposed on the heat-generating elements 9, the main wiring portion 17*a*, part of a region in the sub-wiring portions 17*b*, the lead portions 17*c* of the common electrode 17 and part of a region in the individual electrodes 19.

The protection film 25 is configured to protect the covered region in the heat-generating elements 9, the common electrode 17 and the individual electrodes 19 from corrosion due to adhesion of moisture and so on included in the air or abrasion due to contact with respect to a recording medium to be printed. The protection film 25 can be made of, for example, SiC-based, SiN-based, SiO-based, SiON-based and SiALON-based materials. The protection film 25 can be formed by using, for example, a well-known thin-film forming technique such as sputtering or vapor deposition or a thick-film forming technique such as screen printing. the protection film 25 may be formed by stacking a plurality of material layers.

As shown in FIGS. 1 and 2, a covering layer 27 is disposed on the thermal storage layer 13 formed on the upper surface of the substrate 7, and partially covers the common electrode 17, the individual electrodes 19 and the IC-FPC connection electrodes 21. A forming region of the covering layer 27 is represented by a dashed line and is not shown in FIG. 1 for convenience of explanation. In the shown example, the covering layer 27 is disposed so as to partially cover a region on the right side of the protection film 25 on the upper surface of the thermal storage layer 13.

The covering layer 27 is configured to protect the covered region in the common electrode 17, the individual electrodes 19 and the IC-FPC connection electrodes 21 from oxidation due to contact with respect to the air or corrosion due to adhesion of moisture and so on included in the air. The covering layer 27 is formed so as to overlap with an end portion of the protection film 25 as shown in FIG. 2 for securing the protection of the common electrode 17 and the individual electrodes 19. The covering layer 27 can be made of, for example, resin materials such as epoxy resin or polyimide resin. The covering layer 27 can be made of by using, for example, a thick-film forming technique such as the screen printing method.

As shown in FIGS. 1 and 2, end portions of the sub-wiring portions 17*b* of the common electrode 17 and the IC-FPC connection electrodes 21 connecting the later-described FPC 5 are exposed from the covering layer 27, to which the FPC 5 is connected as described later.

Additionally, an opening (not shown) for exposing end portions of the individual electrodes 19 connecting the driver ICs 11 and the IC-FPC connection electrodes 21 is disposed in the covering layer 27, and these wirings are connected to the driver ICs 11 through the opening. The driver ICs 11 are sealed by being covered by a covering member 29 made of resin such as epoxy resin or silicone resin for protecting the driver ICs 11 themselves and connecting portions between the driver ICs 11 and these wirings in a state of being connected to the individual electrodes 19 and the IC-FPC connection electrodes 21.

The FPC 5 extends along the longitudinal direction of the substrate 7 and is connected to the sub-wiring portions 17*b* of the common electrode 17 and respective IC-FPC connection electrodes 21 as shown in FIGS. 1 and 2 as described above. The FPC 5 is a well-known one in which a plurality of printed wirings are disposed inside an insulating resin layer, in which the respective printed wirings are electrically connected to a not-shown external power supply device, controller and the like through a connector 31. Such printed wirings are generally made of, for example, a metal foil such as a copper foil, a conductive thin film formed by using the thin-film forming technique or a conductive thick film formed by the thick-film forming technique. The printed wirings formed by the metal foil, the conductive thin film or the like are patterned by, for example, partially etching these wirings by photo-etching or the like.

In more detail, in the FPC 5, the respective printed wirings 5*b* formed inside an insulating resin layer 5*a* are exposed at an end portion on the head base 3 side thereof, which are connected to end portions of the sub-wiring portions 17*b* of the common electrode 17 and end portions of respective IC-FPC connection electrodes 21 by a bonding member 32 (refer to FIG. 2) as shown in FIGS. 1 and 2. As the bonding member 32, for example, a solder material or conductive bonding materials such as an anisotropic conductive film (ACF) in which conductive particles are mixed in electric insulating resin can be used.

When the respective printed wirings 5*b* of the FPC 5 are electrically connected to the not-shown external power supply device, controller and the like through the connector 31, the common electrode 17 is electrically connected to a positive-side terminal of the power supply device held in a positive potential of 0 to 24 V. The individual electrodes 19 are electrically connected to a negative-side terminal of the power supply device held in a ground potential of 0 to 1 V through the driver ICs 11 and the ground electrode of the IC-FPC connection electrodes 21. Accordingly, a voltage is applied to the heat-generating elements 9 when the switching devices of the driver ICs 11 are in the on-state, so that the heat-generating elements 9 generate heat.

Similarly, when the respective printed wirings 5*b* of the FPC 5 are electrically connected to the not-shown external power supply device, controller and the like through the connector 31, the IC-power wiring of the IC-FPC connection electrodes 21 is electrically connected to the positive-side terminal of the power supply device held in the positive potential in the same manner as the common electrode 17. Accordingly, a voltage for operating the driver ICs 11 is applied to the driver ICs 11 by a potential difference between the IC power supply wirings of the IC-FPC connection electrodes 21 to which the driver ICs 11 are connected and the ground electrode. The IC control wiring of the IC-FPC connection electrodes 21 is electrically connected to the external controller performing control of the driver ICs 11. Accordingly, an electric signal transmitted from the controller is supplied to the driver ICs 11. The driver ICs 11 are operated so as to control the on/off states of the respective switching devices in the driver ICs 11 by the electric signal, thereby allowing the respective heat-generating elements 9 to generate heat selectively.

A reinforcing plate 33 made of resin such as phenol resin, polyimide resin or glass epoxy resin is disposed between the FPC 5 and the heat dissipation member 1. The reinforcing plate 33 functions so as to reinforce the FPC 5 by being adhered to a lower surface of the FPC 5 by the double-faced tape, adhesives or the like (not shown), thereby fixing the FPC 5 on the heat dissipation member 1. Also, as the reinforcing plate 33 is adhered to the upper surface of the heat dissipation member 1 by the double-faced tape, adhesives or the like (not shown), the FPC 5 is fixed on the heat dissipation member 1.

Hereinafter, a method of allowing the heat-generating elements 9 and the electric resistor layer 15 to contain any one of metal selected from Al, Cu, Ag, Mo, Y, Nd, Cr, Ni and W will be described.

Figure 3:
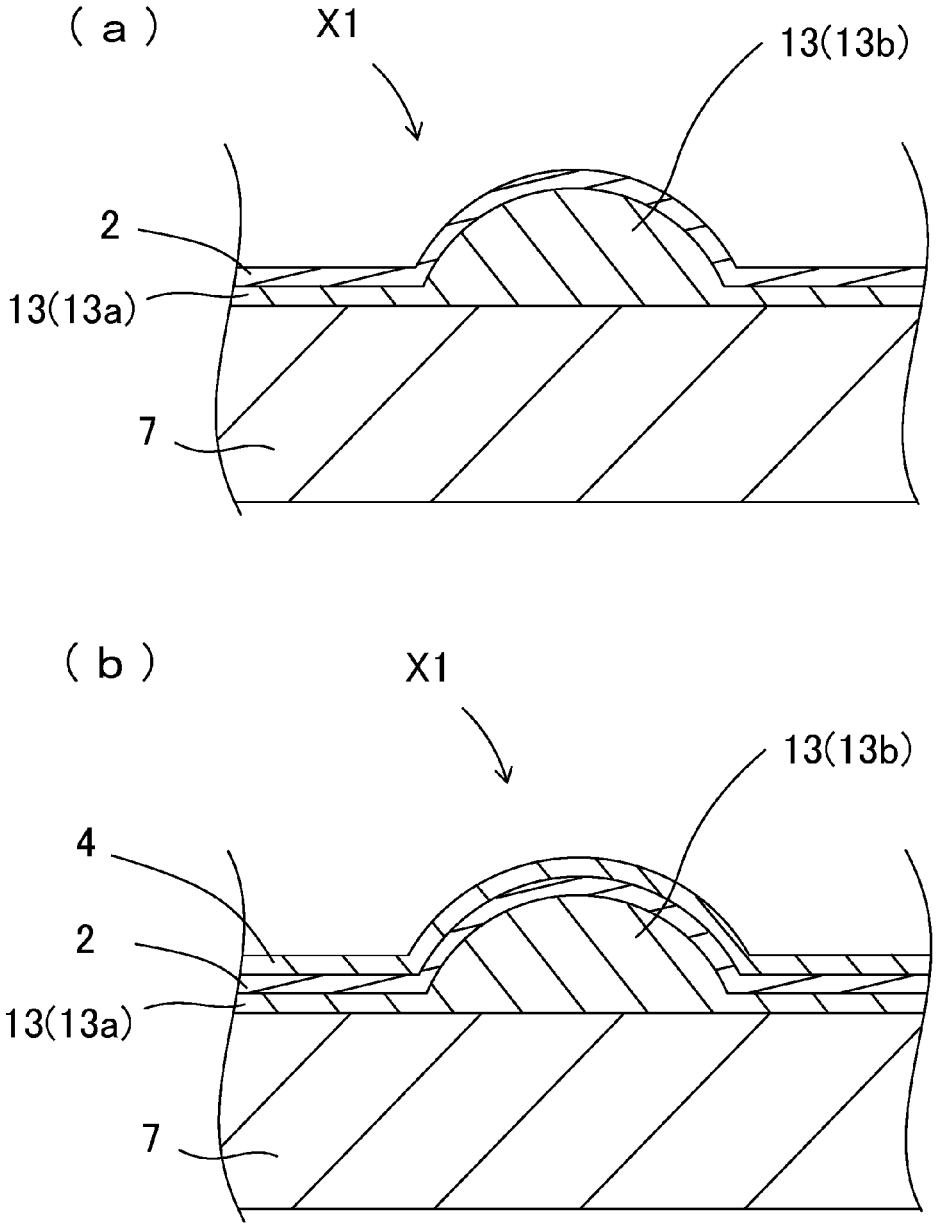
FIGS. 3(*a*) and 3(*b*) are process views showing processes of forming an electric resistor layer, a common electrode and individual electrodes on a thermal storage layer in a region P of FIG. 2.
Figure 5:
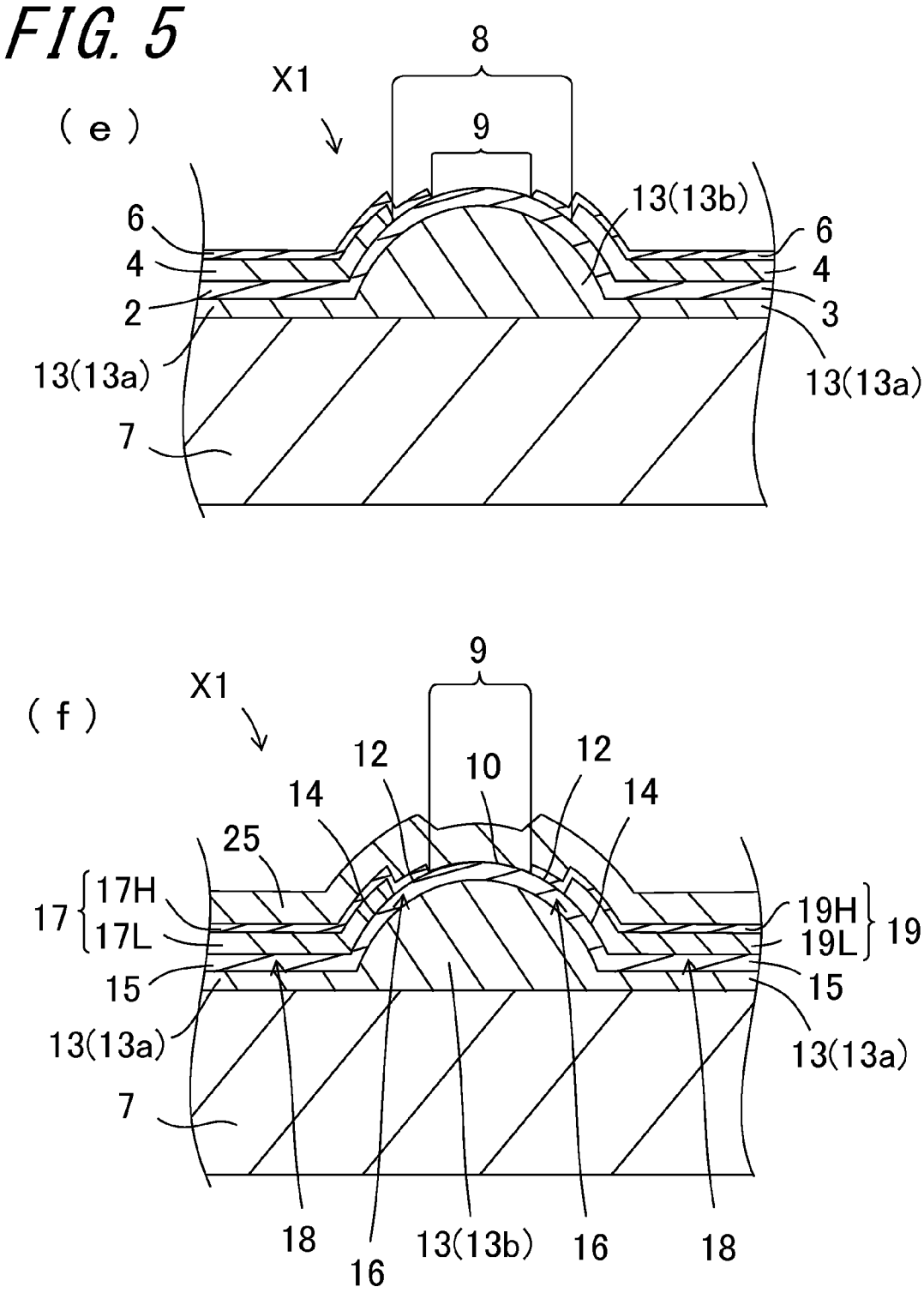
FIGS. 5(*e*) and 5(*f*) are process views showing processes of forming an electric resistor layer, a common electrode and individual electrodes on a thermal storage layer in a region P of FIG. 2.

FIG. 3(*a*) to FIG. 5(*e*) are process views showing processes of forming the electric resistor layer 15, the common electrode 17 and the individual electrodes 19 on the thermal storage layer 13 in a region P shown in FIG. 2. FIG. 5(*f*) is an enlarged view showing part of the thermal head X1 fabricated by the processes of FIG. 3(*a*) to FIG. 5(*e*) in an enlarged manner.

First, as shown in FIG. 3(*a*), a material layer 2 forming the heat-generating elements 9 and the electronic resistor layer 15 is formed on the thermal storage layer 13. More specifically, the material layer 2 having a thickness of 0.01 μm to 0.1 μm is formed on the thermal storage layer 13 by using sputtering or the like as described above.

Next, as shown in FIG. 3(*b*), a lower wiring layer 4 forming the common electrode 17 and the individual electrodes 19 is formed on the material layer 2. More specifically, the lower wiring layer 4 having a thickness of 1 to 2 μm is formed on the material layer 2 by using sputtering or the like as described above.

Figure 4:
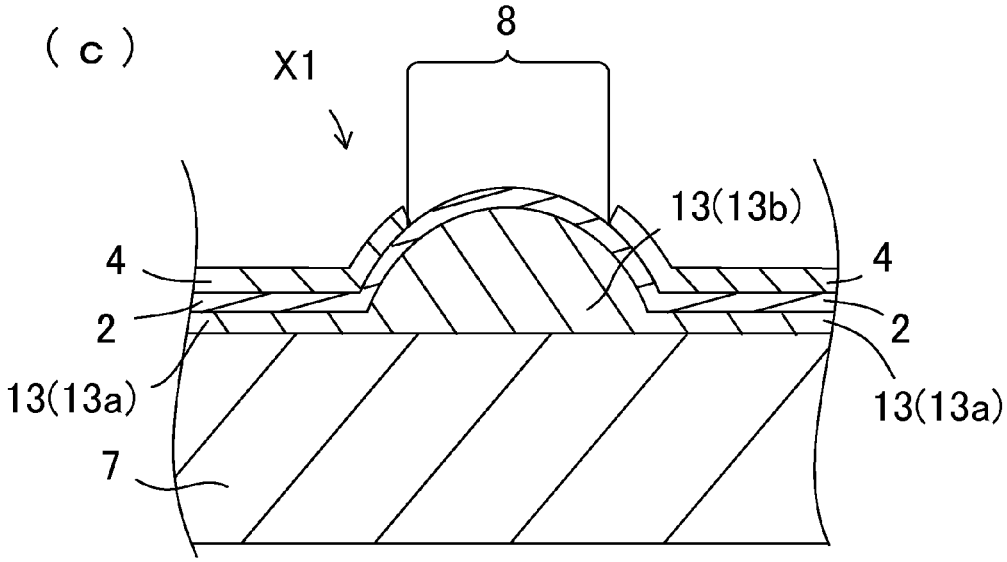
FIGS. 4(*c*) and 4(*d*) are process views showing processes of forming an electric resistor layer, a common electrode and individual electrodes on a thermal storage layer in a region P of FIG. 2.
Figure 4:
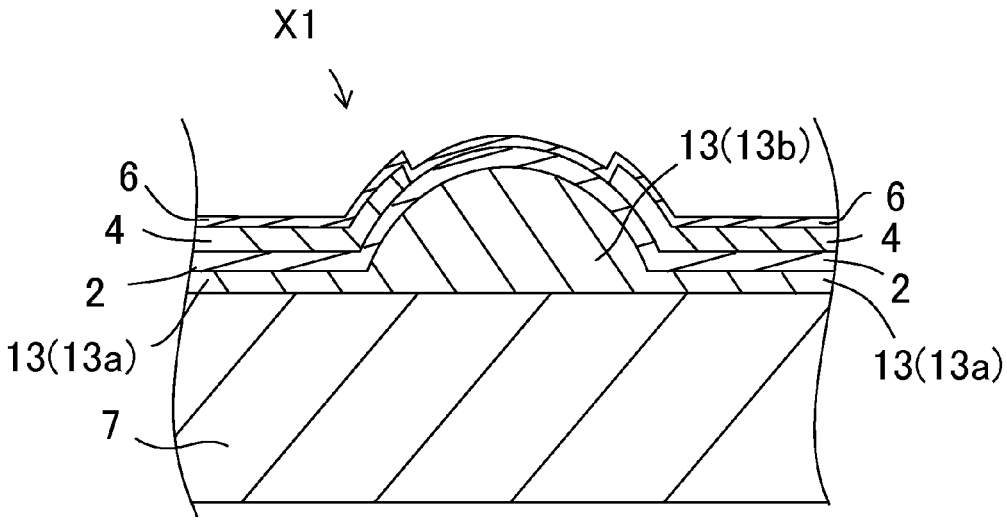

Then, the lower wiring layer 4 is processed to a given pattern by using photo-etching or the like as described above to form an opening region 8 as shown in FIG. 4(*c*). It is preferable that thermal treatment is applied after being processed to the given pattern. In the case where the material layer 2 forming the electric resistor layer 15 is made of TaSiO2 and the lower wiring layer 4 forming the common electrode 17 and the individual electrodes 19 are made of Al, the thermal treatment may be performed by, for example, vacuum heating in a temperature range of 300 to 350° C. for 100 to 500 seconds. It is possible to rearrange a crystal structure of atoms forming the electric resistor layer 15 and to reduce the number of defects in the crystal structure of atoms by performing heating processing.

Next, as shown in FIG. 4(*d*), an upper wiring layer 6 forming the common electrode 17 and the individual electrodes 19 is formed on the material layer 2. More specifically, the upper wiring layer 6 having a thickness of 0.1 to 1 μm on the material layer 2 positioned at the lower wiring layer 4 and the opening region 8 by using sputtering or the like as described above.

Then, thermal treatment is performed to the material layer 2, the lower wiring layer 4 and the upper wiring layer 6 by heating them in the air in a state where the upper wiring layer 6 is formed on the material layer 2 positioned at the opening region 8. Since the thermal treatment is performed, part of metal atoms in the lower wiring layer 4 and the upper wiring layer 6 is diffused into a region in the vicinity of the surface of the material layer 2 and a region in the vicinity of the surface of the lower wiring layer 4. Moreover, part of metal atoms in the lower wiring layer 4 is diffused into a region in the vicinity of the surface of the material layer 2 to become the heating resistor layer 15. Therefore, when the upper wiring layer 6 forming the common electrode 17 and the individual electrodes 19 is made of one metal selected from Al, Cu, Ag, Mo, Y, Nd, Cr, Ni and W or an alloy of these metals, part of metal atoms can be diffused into the material layer 2. Accordingly, the above metals can be contained in regions of the heat-generating elements 9 and the electric resistor layer 15 on the protection film 25 side. That is why these metals are preferably the same metals forming the electrodes.

The opening region 8 is formed, after forming the lower wiring layer 4, by processing the lower wiring layer 4 into a given pattern by photo-etching or the like. Accordingly, the surface of the material layer 2 positioned at the opening region 8 is roughed, and therefore, the degree of surface roughness of the opening region 8 is higher than the degree of surface roughness of other regions in the material layer 2. Accordingly, much metal is diffused into the material layer 2 positioned in the opening region 8 when performing thermal treatment. As a result, much metal is contained in the opening region 8 to become the heat-generating elements 9 as compared with the electric resistor layer 15.

When the metal atoms diffused into the material layer 2 from the lower wiring layer 4 and the upper wiring layer 6 are heated in the material layer 2, the metal atoms are coupled with metal atoms contained in the material forming the material layer 2 and form an intermetallic compound.

The intermetallic compound is formed by metal atoms forming the material layer 2 being coupled with metal atoms diffused from the lower wiring layer 4 and the upper wiring layer 6. In the case where the material layer 2 is made of TaSiO2 and the lower wiring layer 4 and the upper wiring layer 6 are made of Al, an intermetallic compound of Ta and Al is formed.

The above thermal treatment is performed by appropriately setting conditions so that metal atoms forming the lower wiring layer 4 and the upper wiring layer 6 are diffused into the material layer 2 at a temperature in which respective layers of the material layer 2, the lower wiring layer 4 and the upper wiring layer 6 are not sublimed. For example, when the material layer 2 forming the electric resistor layer 15 is made of TaSiO2 and the lower wiring layer 4 and the upper wiring layer 6 forming the common electrode 17 and the individual electrodes 19 are made of Al, thermal treatment may be performed at 300 to 350° C. for 60 to 120 minutes.

Next, as shown in FIG. 5(*e*), the upper wiring layer 6 is processed into a given pattern by photo-etching or the like to thereby form the heat-generating elements 9. Then, the protection film 25 is formed on the heat-generating elements 9, the common electrode 17 and the individual electrodes 19 by the thin-film forming technique, thereby fabricating the thermal head X1 shown in FIG. 5(*f*).

When the electric resistor layer 15, the common electrode 17 and the individual electrodes 19 are formed as described above, at least one metal selected from Al, Cu, Ag, Mo, Y, Nd, Cr, Ni and W can be contained on the surface at least on the later-described protection film 25 side thereof in the exposed regions of the electric resistor layer 15. These metals contained on the surface of the heat-generating elements 9 and the electric resistor layer 15 and the inside thereof can be analyzed by, for example, an X-ray photoelectron spectroscopy (XPS). Additionally, forming of the intermetallic compound and the metal oxide can be checked by X-ray diffraction (XRD) analysis.

The thermal head X1 will be described in detail by using FIG. 5(*f*).

In the thermal head X1, the thermal storage layer 13 is disposed on the substrate 1 and the electric resistor layer 15 is disposed so as to cover the entire surface of the thermal storage layer 13. Then, the common electrode 17 and the individual electrodes 19 are disposed on the electric resistor layer 15. The common electrode 17 includes a lower wiring layer 17L and an upper wiring layer 17H disposed above the lower wiring layer 17L. Furthermore, the first electrode 18 on which the lower wiring layer 17L and the upper wiring layer 17H are stacked and the second electrode 16 formed by the upper wiring layer 17H protruding closer to the heat-generating elements 9 than the lower wiring layer 17L are provided. The individual electrode 19 includes a lower wiring layer 19L and an upper wiring layer 19H disposed above the lower wiring layer 19L. The first electrode 18 on which the lower wiring layer 19L and the upper wiring layer 19H are stacked and the second electrode 16 formed by upper wiring layer 19H protruding closer to the heat-generating elements 9 than the lower wiring layer 19L are provided. Portions which are disposed between the upper wiring layer 17H of the common electrode 17 and the upper wiring layer 19H of the individual electrode 19 and in which the electric resistor layer 15 is exposed, are the heat-generating elements 9.

The thermal head X1 contains metal atoms in a region of the heat-generating elements 9 on the protection film 25 side (hereinafter referred to as "first region 10"), a region positioned below the second electrode 16 (hereinafter referred to as "second region 12") and a region positioned below the first electrode 18 (hereinafter referred to as "third region 14") by the thermal treatment shown in FIG. 4(*d*). Then, a content of metal contained in the first region 10 and the second region 12 is higher than a content of metal contained in the third region 14. Accordingly, power durability in the exposed regions of the electric resistor layer 15 to become the heat-generating elements 9 can be improved in the present embodiment. This point will be described below.

Figure 6:
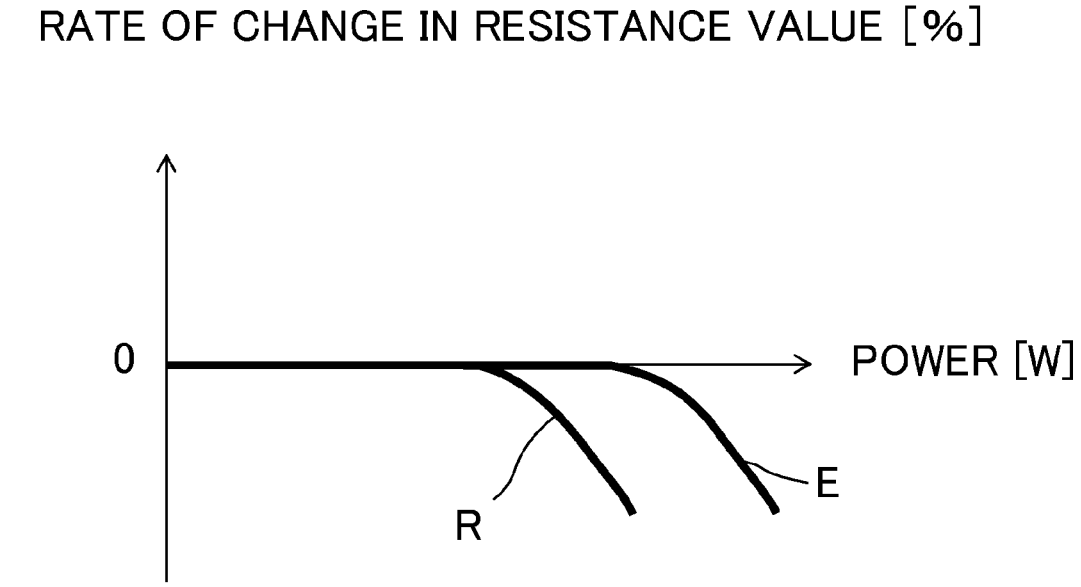
FIG. 6 is a graph conceptually showing results of a step stress test.

FIG. 6 conceptually shows results of a step stress test performed in the case where the exposed regions of the electric resistor layer 15 to become the heat-generating elements 9 contain at least one metal selected from Al, Cu, Ag, Mo, Y, Nd, Cr, Ni and W on the surface on the protection film 25 side thereof (hereinafter referred to as "case of containing the metal") and in the case where the exposed regions do not contain any metal (hereinafter referred to as "case of not containing the metal"). The step stress test is a test in which the power to be applied to an electric resistor is increased in stages to measure the rate of change in the electric resistance value of the electric resistor. In FIG. 6, a horizontal axis represents the power to be applied to the exposed regions of the electric resistor layer 15 to become the respective heat-generating elements 9 and a vertical axis represents the rate of change in the resistance value of the exposed regions of the electric resistance layer 15. Also in FIG. 6, the relation between the applied power and the rate of change in resistance value in the "case of containing the metal" is represented by a curve E and the relation between the applied power and the rate of change in the resistance value in the "case of not containing the metal" is represented by a curve R.

As shown in FIG. 6, a power value at which the resistance value begins to decrease is higher in the curve E in the "case of containing the metal" than in the curve R in the "case of not containing the metal". This seems to be due to the following reasons.

That is, the temperature of the heat-generating elements 9 is increased as the electric value is increased both in the "case of containing the metal" as well as in the "case of not containing the metal". Accordingly, the resistance value of the heat-generating elements 9 is gradually decreased as the heat-generating elements 9 is annealed.

However, in the "case of containing the metal", the metal contained in the region of the heat-generating elements 9 on the protection film 25 side is oxidized as the temperature of the heat-generating elements 9 is increased, which increases the resistance value of the heat-generating elements 9. Therefore, in the "case of containing the metal", the increase of the resistance value due to the oxidization of the contained metal functions so as to cancel out the decrease of the resistance value due to annealing of the heat-generating elements 9. As a result, it is considered that the power value at which the resistance value of the heat-generating elements 9 begins to decrease is higher in the "case of containing the metal" than in the "case of containing the metal".

Accordingly, the power durability of the heat-generating elements 9 can be improved according to the present embodiment.

Since the metal content in the first region 10 which is the metal content of the heat-generating elements 9 is higher than the metal content of the third region 14, the power durability of the heat-generating elements 9 can be effectively improved. Moreover, the metal content of the second region 12 is higher than the metal content of the third region 14 in the thermal head X1. Accordingly, it is possible to improve bonding intensity between the electric resistor layer 15 and the lower wiring layers 17U and 19U in which the bonding intensity is low.

Moreover, since the metal contained in the first region 10 forms the intermetallic compound, the increase of the electric resistance value in an initial stage of the thermal head X1 can be suppressed. Additionally, since a content of the intermetallic compound contained in the first region 10 is higher than a content of the intermetallic compound contained in the third region 14, the electric resistance value of the first region 10 to become the heat-generating elements 9 by application of voltage in the initial stage can be reduced.

Furthermore, since the metal contained in the first region 10 forms a metal oxide, the reduction of the electric resistance value of the heat-generating elements 9 can be suppressed and the power durability of the heat-generating elements 9 can be effectively improved. Since a content of the metal oxide contained in the first region 10 is higher than a content of the metal oxide contained in the second region 12 and the third region 14, the reduction of the electric resistance value of the first region 10 to become the heat-generating elements 9 by application of voltage can be suppressed. Accordingly, the lifetime of the thermal head X1 can be extended.

In the "case of containing the metal" as described above, the metal contained in the region of the heat-generating elements 9 on the protection film 25 side is oxidized with the temperature increase of the heat-generating elements 9. This is because the metal contained in the region of the heat-generating elements 9 on the protection film 25 side is oxidized by being coupled with oxygen of the protection film 25 made of SiO2 or the like. The metal is also oxidized by being coupled with oxygen in the electric resistor layer 15 made of TaSiO2 or the like. Moreover, the metal is oxidized by being coupled with oxygen when oxygen remains between the protection film 25 and the electric resistance layer 15. Furthermore, the metal is oxidized by being coupled with oxygen in the air entering from a film defect when the film defect occurs in the protection film 25.

Accordingly, it is preferable that the protection film 25 contains oxygen from a point of view that the metal oxide is formed. It is also preferable that the heat-generating elements 9 are made of a TaSiO-based, a TaSiNO-based, a TiSiO-based, a TiSiCo-based or a NbSiO-based material from a point of view that the metal oxide is formed.

Figure 7:
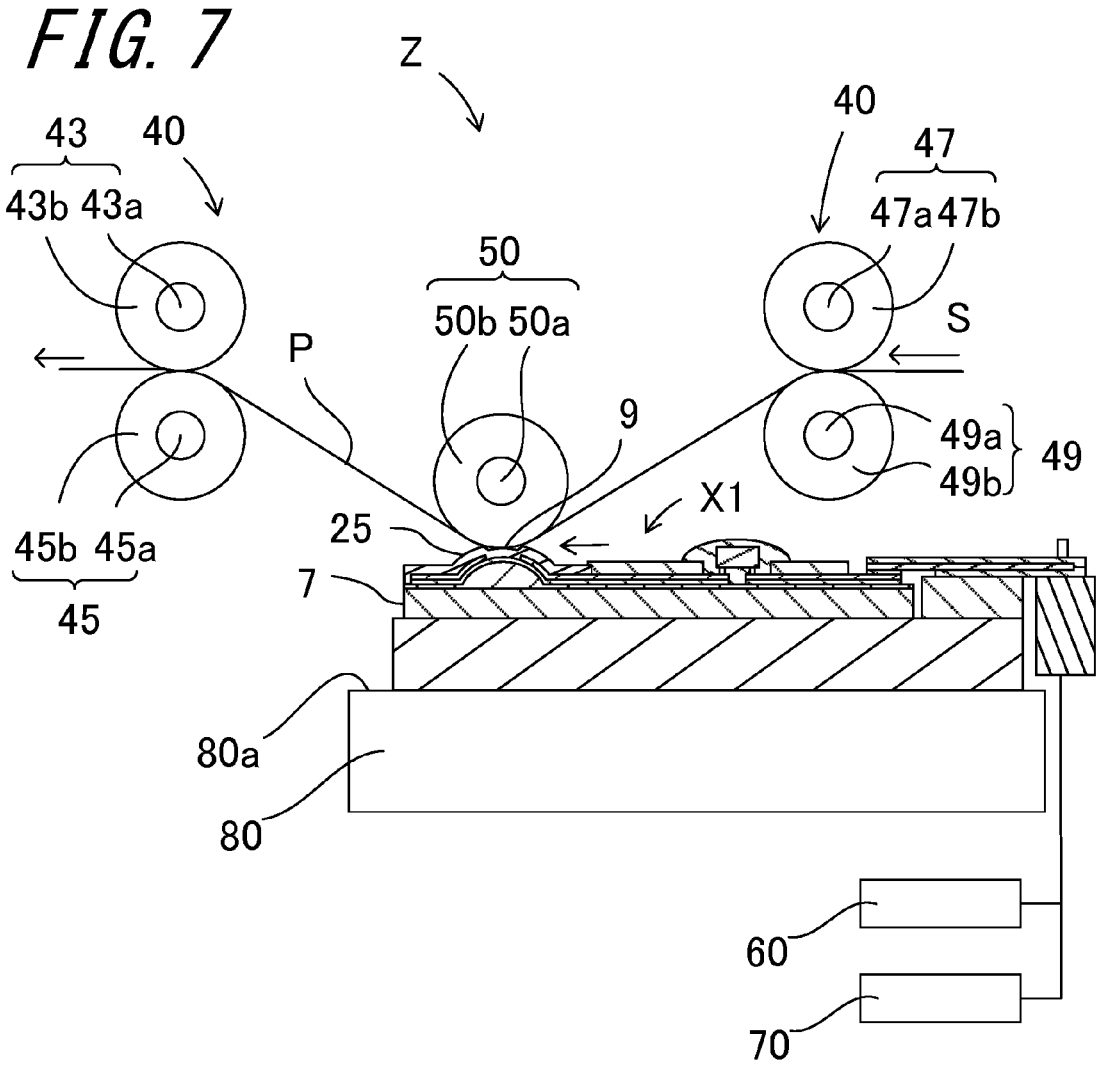
FIG. 7 is a view showing a schematic structure of a thermal printer according to an embodiment of the invention.

Next, a thermal printer according to an embodiment of the invention will be described with reference to FIG. 7. FIG. 7 is a schematic structure view of a thermal printer Z according to the embodiment.

As shown in FIG. 7, the thermal printer Z according to the present embodiment includes the above-described thermal head X1, a conveyance mechanism 40, a platen roller 50, a power supply device 60 and a controller 70. The thermal head X1 is attached to an attachment surface 80*a* of an attachment member 80 disposed in a casing (not shown) of the thermal printer Z. The thermal head X1 is attached to the attachment member 80 so that the arrangement direction of the heat-generating elements 9 is oriented along a direction orthogonal to a conveying direction S of a later-described recording medium P (a main scanning direction), namely, a direction orthogonal to a plane of paper of FIG. 7.

The conveyance mechanism 40 is configured to convey the recording medium P such as heat-sensitive paper or receiver paper on which ink is transferred, in a direction of an arrow S in FIG. 7 to be conveyed on the plurality of heat-generating elements 9 of the thermal head X1, and has conveyance rollers 43, 45, 47 and 49. The conveyance rollers 43, 45, 47 and 49 can be formed by, for example, coating cylindrical shafts 43*a*, 45*a*, 47*a* and 49*a* made of a metal such as stainless steel with elastic members 43*b*, 45*b*, 47*b* and 49*b* made of butadiene rubber or the like. When the recording medium P is the receiver paper in which ink is transferred, an ink film is conveyed together with the recording medium P between the recording medium P and the heat-generating elements 9 of the thermal head X1, though not shown.

The platen roller 50 is configured to press the recording medium P on the heat-generating elements 9 of the thermal head X1, which is disposed so as to extend along a direction orthogonal to the conveying direction S of the recording medium P, both end portions of which are supported so that the platen roller 50 rotates in a state of pressing the recording medium P on the heat-generating elements 9. The platen roller 50 can be formed by, for example, coating a cylindrical shaft 50*a* made of a metal such as stainless steel with an elastic member 50*b* made of butadiene rubber or the like.

The power supply device 60 is configured to apply a voltage for allowing the heat-generating elements 9 of the thermal head X1 to generate heat and a voltage for operating the driver ICs 11 as described above. The controller 70 is configured to supply a control signal controlling the operation of the driver ICs to the driver ICs 11 for allowing the heat-generating elements 9 of the thermal head X1 to generate heat selectively as described above.

The thermal printer Z according to the present embodiment can perform given printing on the recording medium P by allowing the heat-generating elements 9 to generate heat selectively by the power supply device 60 and the controller 70 while pressing the recording medium on the heat-generating elements 9 of the thermal head X1 by the platen roller 50 and conveying the recording medium P on the heat-generating elements 9 by the conveyance mechanism 40 as shown in FIG. 7. When the recording medium P is the receiver paper or the like, the printing on the recording medium P can be performed by thermally transferring ink of the ink film (not shown) conveyed with the receiving medium P on the recording medium P.

Examples

In order to check the power durability and an initial resistance value of the thermal head according to the embodiment of the invention, the following experiment was performed.

A plurality of substrates on which thermal storage layers were formed were prepared, and a material layer made of a TaSiO-based material was deposited over the entire surface of each thermal storage layer to have a thickness of 0.1 μm by using the sputtering method.

Next, a lower wiring layer containing metal elements was deposited over the entire surface of the material layer to have a thickness of 0.5 μm by using the sputtering method. Subsequently, the lower wiring layer positioned on the material layer to become heat-generating elements was removed by photo-etching.

Next, a test specimen including the material layer containing Al was heated in a vacuum in a temperature range of 300 to 350° C. for a 100 to 500 seconds.

Next, an upper wiring layer containing the same metal elements as the lower wiring layer containing metal elements was formed on the lower wiring layer and the material layer to become the heat-generating elements to have a thickness of 1 μm by using the sputtering method. Then, the test specimen including the material layer containing Al was thermally treated at a temperature of 300° C. to 350° C. for 60 minutes to 120 minutes.

Next, the upper wiring layer of the test specimen positioned on the material layer to become the heat-generating elements was removed by photo-etching.

Subsequently, the protection film containing SiO was deposited so as to cover the material layer and the upper electrode layer to have a thickness of 8 μm by using sputtering to thereby fabricate the thermal head.

As a comparative example, the lower wiring layer containing Al was deposited on the substrate on which the material layer was formed to have a thickness of 0.1 μm by using the sputtering method, the lower wiring layer positioned on the material layer to become the heat-generating elements was removed and the protection film was disposed so as to cover the material layer and the lower wiring layer to thereby fabricate a comparative test specimen.

As another comparative example, the lower wiring layer containing Al was deposited on the substrate on which the material layer was formed to have a thickness of 0.5 μm by the sputtering method by performing etching processing to a portion of the material layer corresponding to the third region to become the electric resistor layer, and the lower wiring layer positioned on the material layer to become the heat-generating elements was removed. Next, the upper wiring layer was deposited so as to cover the material layer and the lower wiring layer to have a thickness of 1 μm and is thermally treated at a temperature of 300° C. to 350° C. for 60 minutes to 120 minutes. Subsequently, the upper wiring layer positioned on the material layer to become the heat-generating elements was removed by photo-etching and the protection film containing SiO was deposited so as to cover the material layer and the upper wiring layer to have a thickness of 8 μm by using the sputtering method to thereby fabricate another comparative test specimen.

Then, metal content ratios of heat-generating elements and the electric resistor layers of respective test specimens were respectively calculated by using the X-ray photoelectron spectroscopy. Additionally, the presence of an intermetallic compound in the heat-generating elements and the electric resistor layer was checked by using X-ray diffraction analysis.

Next, initial resistance values of these test specimens were respectively checked. As the initial resistance value, twenty arbitrary heat-generating elements were selected from respective test specimens and electric resistance values of respective heat-generating elements were measured by a given apparatus. Then, an average value of the measured electric resistance values of the heat-generating elements is determined as the initial resistance value.

In order to measure the rates of change in resistance values of respective test specimens, step stress test was performed at 1×104 pulses. The step stress test was performed in conditions in which Tcy was 1000 [usec], Ton was 400 [usec], an initial voltage was 15 [V], a step voltage 1 was 1 [V] and a step voltage 2 was 0.5 [V]. Then, the rate of change in the resistance value was calculated by using the initial resistance value and the electric resistance value after the step stress test.

Next, the presence of a metal oxide contained in the heat-generating elements of respective test specimens after the step stress test was checked. The presence of the metal oxide was checked by using X-ray diffraction analysis.

In the test specimen containing the metal in the heat-generating elements, formation of the metal oxide and the intermetallic compound was confirmed. The initial resistance value was low and the rate of change in the resistance value was also low as a result. However, in the comparative test specimen in which the metal is not contained in the heat-generating elements, the metal oxide and the intermetallic compound were not formed. The initial resistance value was high and the rate of change in the resistance value was also increased.

In the another comparative test specimen, the metal compound and the metallic compound were formed, however, the metal content in the heat-generating elements is lower than the metal content in the electric resistor layer positioned below the first electrode, and the initial resistance value was low but the rate of change in the resistance value was high.

One embodiment of the invention has been described as the above, but the invention is not limited to the above embodiment. Various modifications are possible without departing from the scope of the invention.

For example, in the description of the above embodiment with reference to FIG. 3(*a*) to FIG. 5(*e*), the thermal treatment is performed in the state where the material layer 2 forming the electric resistor layer 15, the lower wiring layer 4 and the lower wiring layer 6 forming the common electrode 17 and the individual electrodes 19 are stacked, thereby diffusing part of metal atoms in the lower wiring layer 4 and the upper wiring layer 6 into the material layer 2, then, part of metal atoms is contained in the surface of the electric resistor layer 15.

In this case, the metal contained in the region of the heat-generating elements 9 on the protection film 25 side will be the same metal as at least one metal selected from one or more metals forming the common electrode 17 and the individual electrodes 19, however, the invention is not limited to this. For example, the metal contained in the common electrode 17 and the individual electrodes 19 may be different from the metal contained in the region of the heat-generating elements 9 on the protection film 25 side as long as the heat-generating elements 9 each contain at least one metal selected from Al, Cu, Ag, Mo, Y, Nd, Cr, Ni and W, at least in the region on the protection film 25 side thereof. In the case where the metal contained in the region of the heat-generating elements 9 on the protection film 25 side is the same metal as at least one metal selected from one or more metals forming the common electrode 17 and the individual electrodes 19, adhesiveness among the electric resistor layer 15, the common electrode 17 and the individual electrodes 19 can be improved.

Figure 8:
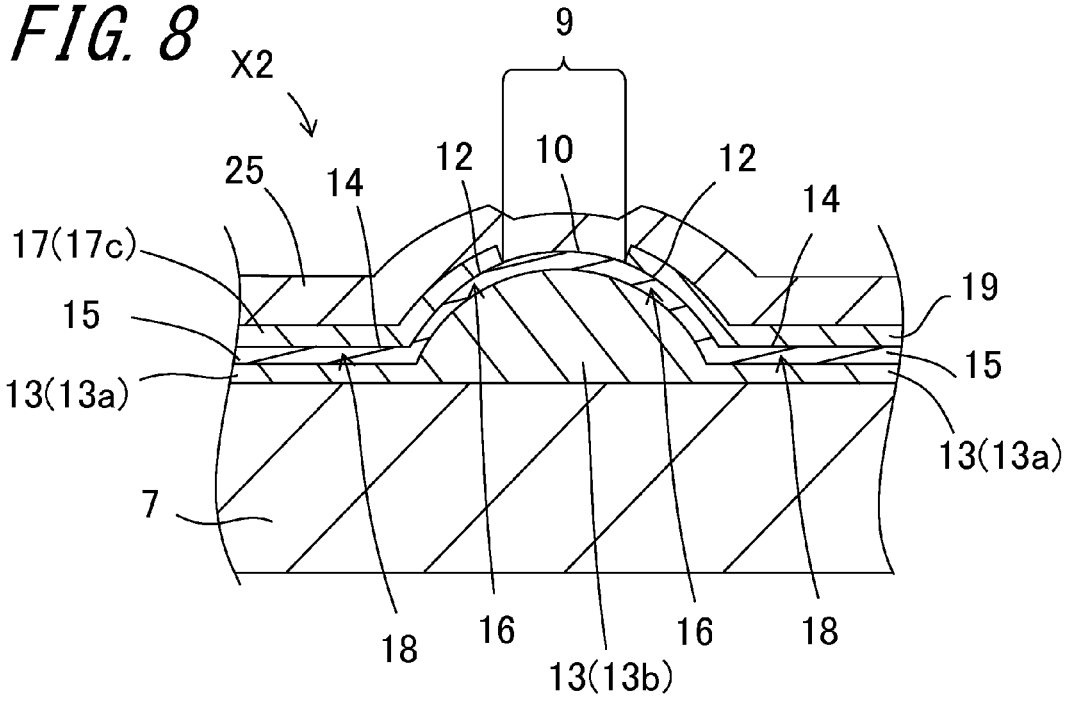
FIG. 8 is an enlarged view showing a thermal head according to another embodiment of the invention in the region P shown in FIG. 2.

Additionally, in the thermal head X1 shown in FIGS. 1 and 2, the common electrode 17 and the individual electrode 19 are formed by two layers respectively, however, the invention is not limited to this. It is also preferable that the common electrode 17 and the individual electrode 19 may be formed by one layer, for example, as a thermal head X2 shown in FIG. 8. In the thermal head X2, the surface of the first region 10 and the second region 12 is roughed by performing surface treatment such as etching to a material layer (not shown) corresponding to the first region 10 and the second region 12. Then, an electrode layer (not shown) is formed over the entire surface of the material layer and thermal treatment is performed to the thermal head X2. Accordingly, much metal can be contained in the first region 10 and the second region 12 as compared to the third region 14. It is also preferable that, the lower wiring layer 4 and the upper wiring layer 6 in the manufacturing method of the thermal head X1 are formed in the same shape in a plan view to thereby fabricate the thermal head X2.

Also in the thermal head X1 shown in FIGS. 1 and 2, the raised portion 13*b* is formed in the thermal storage layer 13 and the electric resistor layer 15 is formed on the raised portion 13*b*, however, the invention is not limited to this. For example, it is also preferable that the raised portion 13*b* is not formed in the thermal storage layer 13 and the exposed regions of the electric resistor layer 15 to become the heat-generating elements 9 are formed in the base portion 13*a* of the thermal storage layer 13. It is further preferable that the thermal storage layer 13 is not formed and the electric resistor layer 15 is directly formed on the substrate 7.

Figure 9:
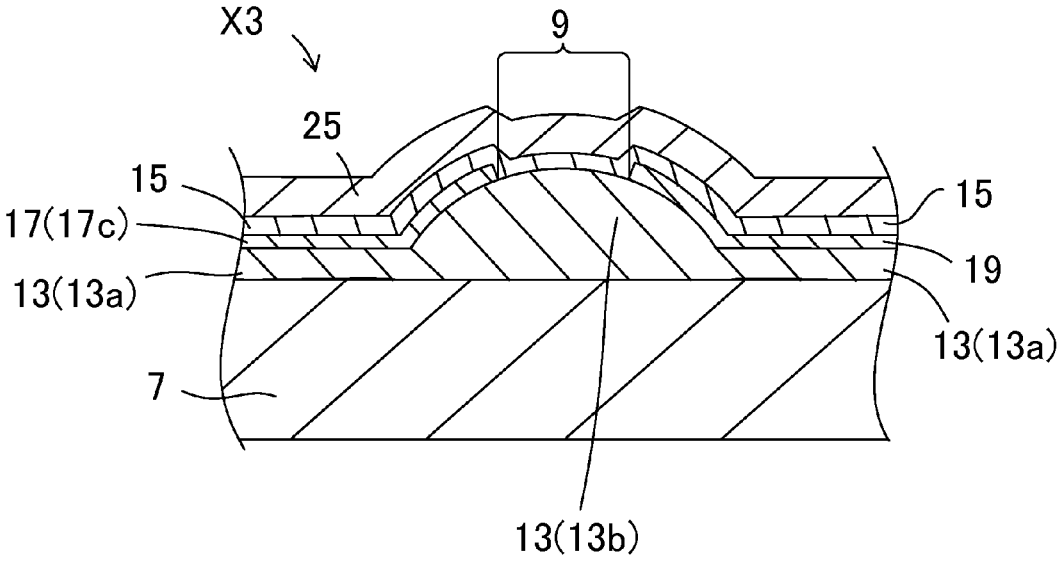
FIG. 9 is an enlarged view showing a thermal head according to still another embodiment of the invention in the region P shown in FIG. 2.

Furthermore, the common electrode 17 and the individual electrodes 19 are formed on the electric resistor layer 15 in the thermal head X1 shown in FIGS. 1 and 2, however, the invention is not limited to this as long as both the common electrode 17 and the individual electrodes 19 are connected to the electric resistor to become the heat-generating elements. For example, it is also preferable that the common electrode 17 and the individual electrodes 19 are formed on the thermal storage layer 13, and the electric resistor layer 15 is formed on the thermal storage layer 13 on which the common electrode 17 and the individual electrodes 19 are formed as shown in FIG. 9. In this case, regions on the electric resistor layer 15 positioned between the common electrode 17 and the individual electrodes 19 will be the heat-generating elements 9.

REFERENCE SIGNS LIST

X1, X2, X3: Thermal head
1: Heat dissipation member
3: Head base
5: Flexible printed circuit board
7: Substrate
9: Heat-generating element
11: Driver IC
17: Common electrode
17*a*: Main wiring portion
17*b*: Sub-wiring portion
17*c*: Lead portion
19: Individual electrode
21: IC-FPC connection electrode
25: Protection film
27: Covering layer

What is claimed is:

1. A thermal head, comprising:
a substrate;
electrodes disposed in a pair on the substrate;
a heat-generating element disposed between the electrodes and electrically connecting the electrodes to one another;
an electric resistor layer disposed below the electrodes; and
a protection film disposed on the electrodes and the heat-generating element,
the electrodes including a first electrode and a second electrode electrically connected to the first electrode and the heat-generating element,
the heat-generating element and the electric resistor layer each containing at least one metal selected from Al, Cu, Ag, Mo, Y, Nd, Cr, Ni and W, in a region on a protection film side thereof, and
a content of the at least one metal contained in the heat-generating element being higher than a content of the at least one metal contained in the electric resistor layer disposed below the first electrode.

2. The thermal head according to claim 1,
wherein the heat-generating element contains an oxide of the at least one metal.

3. The thermal head according to claim 2,
wherein the electric resistor layer contains an oxide of the at least one metal, and
a content of the oxide of the at least one metal contained in the heat-generating element is higher than a content of the oxide of the at least one metal contained in the electric resistor layer.

4. The thermal head according to claim 1,
wherein the content of the at least one metal contained in the heat-generating element is 1 to 5% by atom.

5. A thermal head according to claim 4,
wherein a metal content in the electric resistor layer disposed below the first electrode is 0.1 to 3% by atom.

6. The thermal head according to claim 1,
wherein the at least one metal forms an intermetallic compound other than an oxide of the at least one metal.

7. The thermal head according to claim 1,
wherein the at least one metal is a same metal as at least one metal forming the electrodes.

8. The thermal head according to claim 1,
wherein the heat-generating element is made of a TAN-based, a TaSiO-based, a TaSiNO-based, a TiSiO-based, a TiSiCo-based or a NbSiO-based material.

9. The thermal head according to claim 1,
wherein the protection film contains oxygen.

10. A thermal printer, comprising:
the thermal head according to claim 1;
a conveyance mechanism conveying a recording medium on the heat-generating element; and
a platen roller which presses the recording medium on the heat-generating element.

11. A thermal head according to claim 1, wherein the metal exists in the metal forming the heat-generating element as a solid solution.

12. A thermal head according to claim 1, wherein a metal content of the electric resistor layer disposed below the second electrode is higher than a metal content of the electric resistor layer disposed below the first electrode.

13. A thermal head according to claim 1, wherein a degree of surface roughness of the heat-generating element is higher than a degree of surface roughness of the electric resistor layer disposed below the first electrode.

* * * * *